US011136694B2

(12) United States Patent
Kop et al.

(10) Patent No.: US 11,136,694 B2
(45) Date of Patent: Oct. 5, 2021

(54) SYSTEM AND METHOD FOR MONOFILAMENT YARN PRODUCTION

(71) Applicant: KORDSA TEKNIK TEKSTIL ANONIM ŞIRKETI, Kocaeli (TR)

(72) Inventors: Erhan Kop, Kocaeli (TR); Emine Güven, Kocaeli (TR); Bülent Hindal, Kocaeli (TR); Murat Gökten, Kocaeli (TR)

(73) Assignee: KORDSA TEKNIK TEKSTIL ANONIM SIRKETI, Kocaeli (TR)

( * ) Notice: Subject to any disclaimer, the term of this patent is extended or adjusted under 35 U.S.C. 154(b) by 311 days.

(21) Appl. No.: 16/318,376

(22) PCT Filed: Aug. 3, 2016

(86) PCT No.: PCT/TR2016/050263

§ 371 (c)(1),
(2) Date: Jan. 17, 2019

(87) PCT Pub. No.: WO2018/026333

PCT Pub. Date: Feb. 8, 2018

(65) Prior Publication Data

US 2019/0284724 A1 Sep. 19, 2019

(51) Int. Cl.
*D01D 4/02* (2006.01)
*D01D 7/00* (2006.01)
(Continued)

(52) U.S. Cl.
CPC ..... *D01D 13/02* (2013.01); *D01D 5/08* (2013.01); *D01D 5/0885* (2013.01); *D01D 5/12* (2013.01);
(Continued)

(58) Field of Classification Search
CPC ..... D01D 4/02; D01D 5/0885; D01D 5/12; D01D 5/16; D01D 7/00; D01D 10/02;
(Continued)

(56) References Cited

U.S. PATENT DOCUMENTS 3,002,804 A 10/1961 Kilian
3,960,305 A 6/1976 Boyle et al.
(Continued)

FOREIGN PATENT DOCUMENTS

CN 103290497 B 1/2016
GB 803237 A 10/1958
(Continued)

*Primary Examiner* — Leo B Tentoni
(74) *Attorney, Agent, or Firm* — Bayramoglu Law Offices LLC

(57) ABSTRACT

A multi-end monofilament production apparatus includes the following sequential process units along monofilaments flow direction: a vertical spinning machine comprising a spinneret and a distribution plate below the spinneret; a water bath for quenching spun monofilaments; a vacuum jet device for transferring monofilaments from the water bath; a steam jet able to provide superheated steam at a temperature within the range between 300° C. and 380° C. and at a pressure within the range between 4 bars and 5 bars; a drawing unit; and a monofilament winder for winding monofilaments at a speed exceeding 500 m/min. The present invention further proposes a method for multi-end monofilament yarn production.

14 Claims, 2 Drawing Sheets

(51) Int. Cl.

| | |
|---|---|
| ***D01D 13/00*** | (2006.01) |
| ***D02J 1/22*** | (2006.01) |
| ***D01D 13/02*** | (2006.01) |
| ***D01D 5/088*** | (2006.01) |
| ***D01D 5/12*** | (2006.01) |
| ***D01D 10/02*** | (2006.01) |
| ***D01D 5/16*** | (2006.01) |
| ***D01D 5/08*** | (2006.01) |
| *D01F 6/62* | (2006.01) |
| *D01F 6/60* | (2006.01) |

(52) U.S. Cl.
CPC ..... *D01D 5/16* (2013.01); *D01D 10/02* (2013.01); *D02J 1/222* (2013.01); *D02J 1/228* (2013.01); *D01F 6/60* (2013.01); *D01F 6/62* (2013.01)

(58) Field of Classification Search
CPC . D01D 13/00; D01D 13/02; D02J 1/22; D02J 1/222; D02J 1/228
USPC ..... 264/178 F, 210.3, 210.7, 210.8, 211.12, 264/211.14, 211.15; 425/66, 71, 72.2, 425/377, 378.2, 382.2, 461; 28/240
See application file for complete search history.

(56) References Cited

U.S. PATENT DOCUMENTS

| | | | | |
|---|---|---|---|---|
| 3,963,678 | A | 6/1976 | Du Pont | |
| 5,223,187 | A * | 6/1993 | Chantry | B60C 9/0042 264/178 F |
| 5,240,772 | A | 8/1993 | Henning | |
| 5,518,670 | A * | 5/1996 | Budenbender | D01D 5/0885 264/210.8 X |
| 2006/0014920 | A1 | 1/2006 | Shirakawa et al. | |

FOREIGN PATENT DOCUMENTS

| | | | |
|---|---|---|---|
| JP | 2967997 | B2 | 10/1999 |
| JP | 2006037317 | A | 2/2006 |
| JP | 2011168938 | A | 9/2011 |
| TR | 201403829 | | 4/2014 |
| WO | 9502718 | A1 | 1/1995 |
| WO | 2012047100 | A1 | 4/2012 |

* cited by examiner

SYSTEM AND METHOD FOR MONOFILAMENT YARN PRODUCTION

CROSS REFERENCE TO THE RELATED APPLICATIONS

This application is the national phase entry of International Application No. PCT/TR2016/050263, filed on Aug. 3, 2016, the entire contents of which are incorporated herein by reference.

TECHNICAL FIELD

The present invention relates to a system and method for production of yarns, more specifically for production of high tenacity monofilament yarns.

BACKGROUND

A typical commercial monofilament production line includes these sequential process steps/parts: extrusion, cooling of extruded filament through a water bath, a first drawing zone, a further (second) drawing zone, heat treatment, and winding of the produced monofilament yarn. Such commercial monofilament production lines normally achieve winding speeds of about 150 to 300 m/min (a.k.a. mpm: meters of yarn per minute) for tire-grade monofilaments, and they generally run in a horizontal direction which corresponds to allocation of wide footprint areas (with a length of about 25 m to 35 m) for production systems.

U.S. Pat. No. 5,240,772 A discloses a process to produce polyamide monofilaments having a linear density higher than 1000 denier with a tenacity greater than 7.5 gpd (gram-force per denier). A polymer relative viscosity (with respect to the viscosity of formic acid) greater than 50, and a water bath for keeping monofilament core temperature below 55° C., were used. A draw point localizer and steamer were employed for maintaining required mechanical properties in the product such as strength for resisting the tensions occurring whilst winding or in use. At this process, first stage draw rolls were heated to 140° C. for heating the monofilament prior to entering the second drawing zone; and the draw point localizer and steamer were located after the feed roll for enhancing the drawing rate. Additionally, a radiant heater was also employed in the system for heat treatment.

U.S. Pat. No. 3,963,678 A discloses another process for polyamide monofilaments production with a linear density higher than 1000 denier with 10 gpd, wherein monofilaments are spun at a throughput between 13 kg/h and 20 kg/h (kilograms per hour). But the number of end monofilaments produced for achieving this throughput was not disclosed. In high-speed spinning of monofilaments, it is a great challenge to manage continuous production of monofilaments with more than four ends. This challenge necessitates designing of a new process, apparatus and method. Sequential employment of a draw point localizer and a steamer is disclosed in the document. The monofilaments are coated with water at a temperature ranging between 95° C. and 98° C. Furthermore, the steamer disclosed in the document applies a pressure between 80 to 140 psig (5.51 bar to 9.65 bar) with a steam temperature of 180° C. The maximum winder speed was disclosed as 516.7 m/min, still without disclosing the number of monofilament ends.

Achieving high speeds (e.g. 500 m/min or higher) in monofilament yarn production is an extremely big challenge, especially when a high number of ends is aimed in the yarn. When high denier value and high number of ends are targeted in monofilament yarn production, several problems are videly encountered, such as insufficient cooling in the water tank upon extrusion, difficulties in catching of filaments by suction gun, and separately wrapping of filaments in godets. Furthermore, commercial monofilament lines have low production capacity due to low winding speeds required for prevention of damaging the product.

WO 95/02718 discloses a method for high-speed production of multifilament yarns. Here, molten polyamide filaments are extruded from spinneret capillaries through a gas-filled gap and into a quench bath which contains a heated aqueous liquid. The bath has a nozzle defining a vertically disposed cylindrical passageway with its entrance in the bath below the bath surface. The filaments are converged into a filament bundle at the entrance and withdrawn from the exit of the passageway at a withdrawal speed of about 1500 to about 3500 meters per minute. The polyamide polymer is extruded from the spinneret; such that the jet velocity in the spinneret capillaries is between 2 and 10% of the withdrawal speed of the filament from the exit of the nozzle passageway.

GB 803 237 A discloses a method for production of artificial filaments by melt-spinning, comprising extruding the molten polymeric material through a spinneret and winding or forwarding the filaments to the next operation; the tension in the extruded filaments is raised and they are attenuated by passing through a hot liquid. U.S. Pat. No. 3,002,804 A discloses a process of melt spinning and stretching filaments by passing them through a liquid drag bath.

U.S. Pat. No. 3,960,305 A relates to an aspirating apparatus including a suction nozzle. WO 2012/047100 A1 relates to a process for the preparation of polymer filaments having a high tensile strength and modulus by extrusion of a solution of a solvent and linear high-molecular Weight polymer and subsequent spinning and quenching of the filaments thus formed, Wherein after spinning and quenching the as-spun filaments are stretched under contact with steam for removing the solvent from filaments being stretched.

US 2006/014920 A1 discloses a multifilament yarn production method at high speeds. CN 103 290 497 A relates to a method for production of yarns made from Nylon 66, using solid state polymerization, melt extrusion, high-pressure spinning, slow cooling, quenching, drafting and shaping. JP 2011 168938 A discloses a nylon 66 fiber for airbags, and its production method. JP 2 967997 B2 relates to production of high strength filaments using spinning.

SUMMARY

Primary object of the present invention is to overcome the abovementioned shortcomings of the prior art.

Another object of the present invention is provision of a method of obtaining high denier monofilament yarn having high number of ends, at an enhanced production speed.

A further object of present invention is provision of a process and method of monofilament yarn production with decreased investment and operational costs.

The present invention proposes a multi-end monofilament production apparatus comprising the following sequential process units along monofilaments flow direction: a vertical spinning machine comprising a spinneret and a distribution plate below the spinneret; a water bath for quenching spun monofilaments; a vacuum jet device for transferring monofilaments from the water bath; a steam jet able to provide superheated steam at a temperature within the range between 300° C. and 380° C. and at a pressure within the range between 4 bars and 5 bars; a drawing unit; and a monofilament winder for winding monofilaments at a speed exceeding 500 m/min. The present invention further proposes a method for multi-end monofilament yarn production.

BRIEF DESCRIPTION OF THE DRAWINGS

The figures, whose brief explanations are herewith provided, are solely intended for providing a better understanding of the present invention and are as such not intended to define the scope of protection or the context in which the scope is to be interpreted in the absence of the description.

DETAILED DESCRIPTION OF THE EMBODIMENTS

Referring now the figures outlined before, the present invention proposes an apparatus and method for monofilament yarn production.

The method according to the present invention includes the sequential steps of i) spinning of monofilaments from a spinneret having extrudate outlet holes, onto a distribution plate in a direction which is substantially parallel and co-directional with the gravity vector;

ii) quenching the spun monofilaments in a water bath which is kept at a temperature within the range between 7° C. and 20° C., wherein an air gap is present between the spinning machine and the water bath, the air gap corresponding to a distance within a range between 20 cm and 80 cm between the water bath and extrudate outlet holes of the spinneret;

iii) transferring the monofilaments from the water bath using a vacuum jet device;

iv) provision of superheated steam at a temperature within the range between 300° C. and 380° C. and at a pressure within the range between 4 bars and 5 bars, onto the monofilaments, using a steam jet;

v) drawing the monofilaments using a drawing unit;

vi) winding the monofilaments at a speed exceeding 500 m/min, using a monofilament winder.

Figure 1:
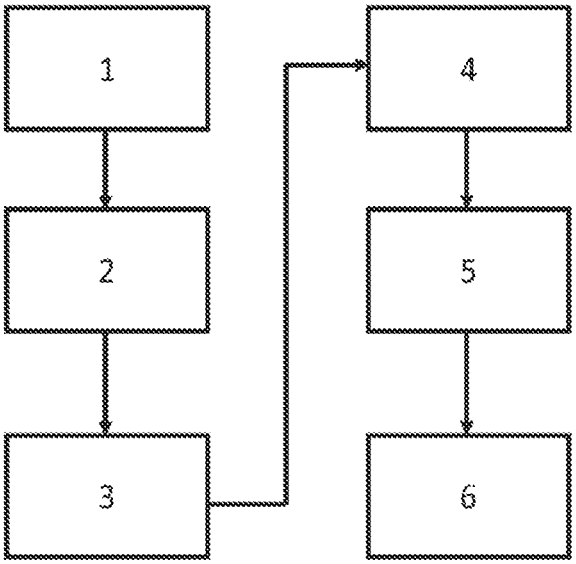
FIG. 1 is a schematic showing the process units of the apparatus corresponding to process steps along the production line according to the method of the present invention.
Figure 2:
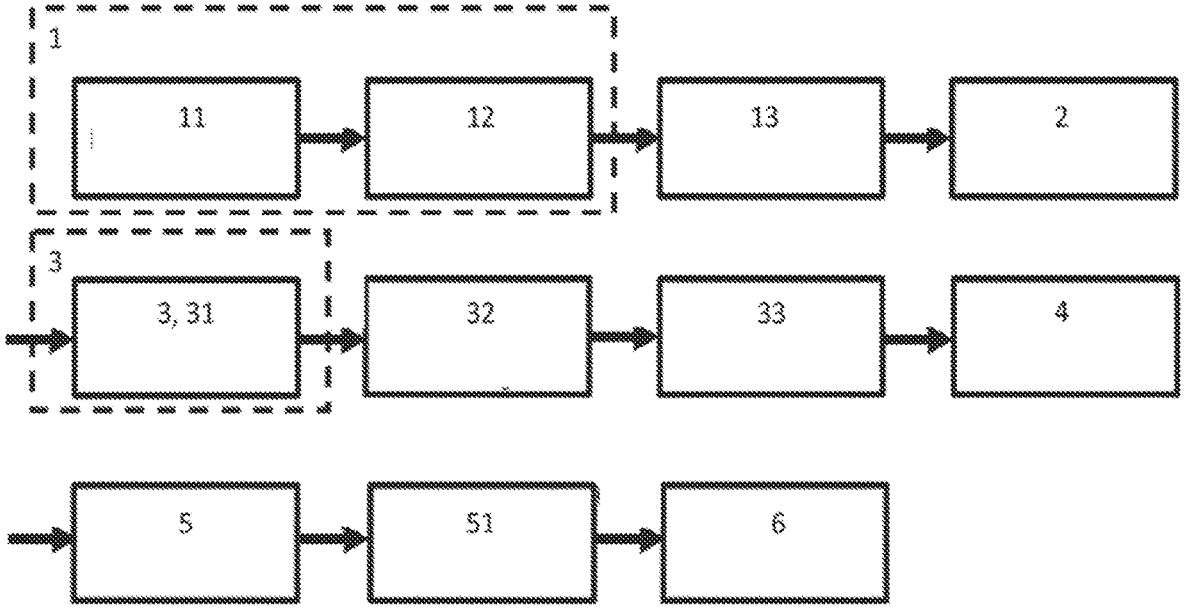
FIG. 2 shows a schematic view of an embodiment of the apparatus according to the present invention, corresponding to a version of the method according to the present invention.

The schematic of the apparatus according to the present invention is given in FIG. 1, wherein the sequence between process units in the apparatus is emphasized with arrows, also corresponding the flow direction of extrudate (thus of filaments) throughout the apparatus. The same applies to the FIG. 2, wherein a preferred embodiment of the apparatus and the flow direction in production are schematized.

The apparatus includes a spinning machine (1) having an extrusion outlet for letting the extrudate out in a mainly vertical direction (mainly parallel and co-directional with the gravity vector, i.e. downwards, i.e. towards the center of gravity of the Earth, with a maximum of 5° (over 360°) deviation from a rope of a stagnant pendulum at an equilibrium position, in use). Accordingly, such spinning machine is considered definable as a vertical spinning machine. The apparatus further includes a water bath (2) (which can also be named as quenching tank), for quenching and crystallinity optimization of fibers upon exiting the spinning machine (1). The water bath (2) is followed by a vacuum jet device (3) for transferring filaments in vertical direction (downwards). The vacuum jet device is followed by a steam jet (4) which provides superheated steam at a temperature within a range between 300° C. and 380° C., preferably within a range between 345° C. and 355° C. The pressure of the steam is preferably within a range between 4 bar and 5 bar.

Uniform coating of monofilament with water is of great importance, since otherwise monofilaments become brittle, have lower elongation at breaking, and have lower tenacity.

The apparatus and method according to the present invention provides enhanced modulus, and an enhanced speed throughout the process which corresponds to 3-4 times higher capacity when compared to typical commercial spinning lines. Increased capacity corresponds to decreased product costs thanks to low operation cost per unit volume of the product (i.e. monofilament yarn). The production line being mainly vertical provides that the apparatus requires a minimized footprint, corresponding to a reduced investment cost in terms of space use. The cost reduction is calculated as approximately 50% when compared to readily available commercial monofilament spinning systems. Furthermore, the spinning being vertical allows 3-4 times faster spinning when compared to known commercial polyamide monofilament production lines.

EXAMPLE

In exemplary trials of the method and apparatus according to the present invention, a winding speed of 1300 m/min was achieved for 12-end monofilament yarn production. The filaments had linear mass density values ranging from 100 dtex at a filament diameter of 0.1 mm, to 3000 dtex at a filament diameter of 0.6 mm; wherein dtex is abbreviation of decitex (i.e. the mass of the filament in grams per 10000 meters). Process parameters and mechanical properties of respected products were summarized in the Table 1 (cf. Table 1 summarizing process parameters and resulting physical properties of the products at several experimental runs according to the apparatus and method of the present invention). Load at 3% of elongation (a.k.a. 3% LASE) and elongation (%) at 4.5 kgf (a.k.a. E 4.5) were considered as indicating the modulus. The modulus of the obtained product was 30-35% higher when compared with the typical commercial monofilaments. For 'tire cord' application, a tenacity value of 7.5 gpd (abbreviation of gram-force per denier) is considered sufficient. Monofilament yarns with higher modulus values are advantageous in achieving increased stiffness in tires and accordingly decreased rolling resistance thereof.

The apparatus according to the present invention, which was used in the exemplary runs (cf. FIG. 2) includes a vertical spinning machine (1), comprising a spinneret (11) and a distribution plate (12) below the latter for receiving the extrudate flow (travelling from the spinneret in a vertical direction) to form the monofilament yarn. The flow (shown with arrows) continues into the water bath (2). At the apparatus used in the experiments, maintaining an air gap (13) was preferred between the spinning machine (1) and the water bath (2). The water bath (2) was followed by a vacuum jet device (3) which was preferentially further provided with a water stripping device (31). The filaments past through the vacuum jet device (3) were caught by a suction gun (32) (which also could be named as suction jet), and directed to a first drawing zone (33), and then the filaments were subjected to a steam jet (4) followed by a further (second)

drawing zone as a main drawing unit (5). At the steam jet (4), steam is applied onto filaments at a pressure of 4.5 bar. The filaments were then subjected to a relaxing (51) step, and end up by high speed winding in a winder (6). The term 'high speed' was used for speeds exceeding 500 m/min, more preferably exceeding 1000 m/min, even more preferably higher than 1200 m/min. A winding speed of 1300 m/min was used at the experimental runs.

In the experimental runs, a freefall relative viscosity with respect to that of formic acid within the range between 88 and 100 was employed, and more preferably the freefall relative viscosity was within a range between 93 and 97. At formic acid relative viscosities of freefall polymer ranging between 75 and 100 (ASTM D 789), tenacity of 9.0 gpd and modulus (at 2% strain) of 5.7 GPa (gigapascal, $10^9$ N/m$^2$) were achieved at 1300 m/min winder speed. The polyamide at this relative viscosity was melt and extruded through an 12-hole spinneret into a water bath for quenching of spun monofilaments. An air gap (distance allowing the spun monofilaments to contact with air for a preferred pre-cooling of the freshly-spun filaments) within a range between 20 cm and 80 cm was present between the water bath and the spinneret holes. Said distance also increases the crystallinity level of the monofilament material before entering the water bath.

The tenacity, modulus and shrinkage behavior of the (mono-) filaments start to develop by further increasing the crystallinity level thereof whilst passing through the water bath. To this end, the water bath temperature is preferably kept within a range between 7° C. and 20° C.

The monofilaments were preferentially pulled by a puller roll on the exit of the water bath, wherein the puller roll serves by throwing the filaments (e.g. onto the floor in front of the exit of the water tank), before the filaments get subjected to the vacuum jet. In each experimental run, the linear velocity on the surface of the puller roll which contacts to the filaments was adjusted to a value within the range between 100 m/min and 300 m/min, in accordance with dtex value of the monofilaments and winder speed.

Monofilaments are preferably dewatered before contacting the puller roll. The monofilaments (which may be fallen onto the floor) may be directed by an operator to the vacuum jet. Vacuum jet apparatus throws down the monofilaments to the drawing unit, and is critical for transferring of the (multiple-end, e.g. 12-end) monofilament at high speed e.g. 1300 m/min.

The monofilaments transferred to the drawing unit can preferably be caught according to a method described in TR 2014/03829. Then the monofilaments are wrapped around a feed roll. Here, no drawing is wanted between the puller roll and feed roll, therefore the linear velocity at the side surfaces of the feed roll is close to that of the puller roll. In such case, the ratio between the linear velocities at side surfaces of the feed roll and the puller roll is preferably within a range between 0.95 and 1.05.

Between the feed roll and first stage rolls, the monofilaments were subjected to steam for draw point localization and for increasing draw ratio. Steam was applied through an opening at a temperature within a range between 300° C. and 380° C., more preferably between 300° C. and 340° C., even more preferably between 310° and 330° C. In the experimental runs, the steam temperature was 320° C. The steam pressure was kept within a range between 4 bars and 5 bars.

Then, the monofilaments were transferred to a (main) drawing unit (which also could be named as second stage rolls) where a maximum draw ratio was applied onto the monofilaments, at a high speed (for the experimental runs, the speed was up to 1400 m/min). The tenacity develops mainly in this stage. For optimal tenacity values, preferably, the monofilament contact surface of the rolls at the main drawing unit are to be kept at a temperature within the range between 225° C. and 250° C., more preferably between 235° C. and 245° C. In the experimental runs, the surface temperature of the rolls at the main drawing unit was kept at 240° C. At a winding speed of 1300 m/min for 12 end monofilaments, a total draw ratio of about 5.05× was achieved with the method according to the present invention.

In the experimental runs, the monofilaments were transferred to relaxing rolls upon leaving the main drawing unit. Afterwards, the monofilaments were transferred to flanged bobbins on winder with a suction gun (suction jet). In order to provide enhanced productivity, the monofilaments were transferred through the rolls separately. The method and apparatus according to the present invention allowed a polymer throughput rate ranging between 16 to 67 kg/h depending on linear mass density of the monofilaments. Furthermore, at to the experimental runs, 3 to 4 times higher spinning speeds were achieved when compared to the known commercial production lines; notwithstanding the cross-sectional shape of the product.

The method and apparatus according to the present invention are especially suitable for production of monofilaments with high number of ends, which corresponds to higher than 4-end monofilaments, more preferably for monofilaments with 12 or more ends, since lossless high-speed production of 12 or more ends monofilaments is highly enhanced with the method and apparatus according to the present invention.

TABLE 1

Process parameters and physical properties of resulting product (monofilament yarn)

| | Run # | | | | |
|---|---|---|---|---|---|
| | 1 | 2 | 3 | 4 | 5 |
| Linear mass density of the product (dtex) | 475 | 475 | 475 | 810 | 1100 |
| Spinnert-water distance (mm) | 300 | 300 | 300 | 200 | 200 |
| Water quench (water bath) temperature (° C.) | 20.00 | 10.00 | 10.00 | 18.00 | 15.00 |
| Feed Roll Speed (m/min) | 122 | 195 | 292 | 129 | 133 |
| Second stage draw roll (m/min) | 619 | 900 | 1400 | 619 | 583 |
| Winder speed (m/min) | 613 | 885 | 1300 | 603 | 600 |
| First draw ratio (speed of 1.stage roll/feed roll) | 3.10 | 2.60 | 2.70 | 2.80 | 2.50 |

TABLE 1-continued

| Process parameters and physical properties of resulting product (monofilament yarn) | Run # | | | | |
|---|---|---|---|---|---|
| | 1 | 2 | 3 | 4 | 5 |
| Total draw ratio (speed of 2. stage roll/feed roll) | 5.05 | 4.60 | 4.79 | 4.80 | 4.40 |
| Relaxation (%) | 3.00 | 3.00 | 5.00 | 3.00 | 4.00 |
| Steam jet temperature (° C.) | 280 | 330 | 320 | 330 | 329 |
| Tenacity (gpd) (according to ASTM D 885) | 9.0 | 8.7 | 8.2 | 7.8 | 7.5 |
| Elongation at Break (%) (ASTM D 885) | 16.8 | 16.7 | 18 | 18.1 | 20.1 |
| Load at 3% of elongation (3% LASE) (ASTM D 885) | 0.63 | 0.6 | 0.65 | 0.97 | 1.12 |
| Elongation (%) at 4.5 kgf (E 4.5) (ASTM D 885) | — | — | — | 12.5 | 11.15 |
| Modulus (GPa) (ASTM D 885) | 5.2 | 5.4 | 5.7 | 5.2 | 5.0 |

What is claimed is:

1. A multi-end monofilament production apparatus, comprising the following process units along a monofilament flow direction sequentially:

a spinning machine comprising a spinneret and a distribution plate, wherein the spinneret comprises a plurality of extrudate outlet holes, and the distribution plate is below the spinneret;

a water bath configured to provide a water bath temperature for quenching spun monofilaments, wherein a range of the water bath temperature is-between 7° C. and 20° C.;

a vacuum jet device configured for transferring the spun monofilaments from the water bath;

a steam jet configured to provide superheated steam, wherein a range of a temperature of the superheated steam is between 300° C. and 380° C., and a range of a pressure of the superheated steam is between 4 bars and 5 bars;

a drawing unit; and a monofilament winder configured for winding the spun monofilaments at a speed exceeding 500 m/min;

wherein an air gap is provided between the spinning machine and the water bath, a length of the air gap corresponds to a distance between the water bath and each of the plurality of extrudate outlet holes of the spinneret, and a range of the distance is between 20 cm and 80 cm.

2. The multi-end monofilament production apparatus according to claim 1, wherein the monofilament winder is configured to provide a speed exceeding 1000 m/min.

3. The multi-end monofilament production apparatus according to claim 2, wherein the monofilament winder is configured to provide a speed exceeding 1200 m/min.

4. The multi-end monofilament production apparatus according to claim 1, further comprising a suction gun, and a first drawing zone; wherein the first drawing zone is between the vacuum jet device and the steam jet.

5. A method of producing a multi-end monofilament yarn, comprising the following steps:

i) spinning a monofilament from a spinneret a distribution plate to obtain a spun monofilament, wherein the spinneret comprises a plurality of extrudate outlet holes, a direction of the distribution plate is parallel and co-directional with a gravity vector;

ii) quenching the spun monofilament in a water bath, wherein a range of a temperature of the water bath is between 7° C. and 20° C., an air gap is provided between a spinning machine and the water bath, a length of the air gap corresponds to a distance between the water bath and each of the plurality of extrudate outlet holes of the spinneret, and a range of the distance is between 20 cm and 80 cm;

iii) transferring the spun monofilament from the water bath using a vacuum jet device, iv) provisioning superheated steam to the spun monofilament using a steam jet, wherein a range of a temperature of the superheated steam is between 300° C. and 380° C., and a range of a pressure of the superheated steam is between 4 bars and 5 bars, v) drawing the spun monofilament using a drawing unit, vi) winding the spun monofilament at a speed exceeding 500 m/min, using a monofilament winder.

6. The method according to the claim 5, wherein the speed is higher than 1000 m/min.

7. The method according to the claim 5, wherein the speed is higher than 1200 m/min.

8. The method according to claim 5, further comprising the following steps between the step iii) and the step iv):

sucking the spun monofilament using a suction gun, and performing a first drawing on the spun monofilament at a first drawing zone.

9. The method according to claim 5, wherein a number of ends of the multi-end monofilament yarn is equal to or larger than 12.

10. The multi-end monofilament production apparatus according to claim 2, further comprising a suction gun, and a first drawing zone; wherein the first drawing zone is between the vacuum jet device and the steam jet.

11. The multi-end monofilament production apparatus according to claim 3, further comprising a suction gun, and a first drawing zone wherein the first drawing zone is between the vacuum jet device and the steam jet.

12. The method according to claim 6, further comprising the following steps between the step iii) and the step iv):

sucking the spun monofilament using a suction gun, and performing a first drawing on the spun monofilament at a first drawing zone.

13. The method according to claim 6, wherein a number of ends of the multi-end monofilament yarn is equal to or larger than 12.

14. The method according to claim 7, wherein a number of ends of the multi-end monofilament yarn is equal to or larger than 12.

* * * * *